US008953828B2

(12) United States Patent
Karlsen

(10) Patent No.: US 8,953,828 B2
(45) Date of Patent: Feb. 10, 2015

(54) HEARING AID RETAINER ACCESSORY

(71) Applicant: Oticon A/S, Smørum (DK)

(72) Inventor: Morten Friis Karlsen, Smørum (DK)

(73) Assignee: Oticon A/S, Smørum (DK)

( * ) Notice: Subject to any disclaimer, the term of this patent is extended or adjusted under 35 U.S.C. 154(b) by 31 days.

(21) Appl. No.: 13/659,489

(22) Filed: Oct. 24, 2012

(65) Prior Publication Data

US 2013/0101148 A1 Apr. 25, 2013

Related U.S. Application Data

(60) Provisional application No. 61/550,931, filed on Oct. 25, 2011.

(30) Foreign Application Priority Data

Oct. 25, 2011 (EP) ..... 11186431

(51) Int. Cl.
*H04R 25/00* (2006.01)

(52) U.S. Cl.
CPC ..... *H04R 25/65* (2013.01); *H04R 25/60* (2013.01); *H04R 25/602* (2013.01); *H04R 2225/021* (2013.01); *H04R 2225/63* (2013.01)
USPC ..... 381/324; 381/312; 381/322; 381/323; 381/330

(58) Field of Classification Search
CPC ..... H04R 25/60; H04R 25/602; H04R 25/65; H04R 2225/021; H04R 2225/63; H04R 2205/02
USPC ..... 381/330, 381, 312, 322–324, 329
See application file for complete search history.

(56) References Cited

U.S. PATENT DOCUMENTS

| | | | | |
|---|---|---|---|---|
| 3,327,807 | A | 6/1967 | Mullin | |
| 4,702,345 | A | 10/1987 | Janssen et al. | |
| 4,881,616 | A | 11/1989 | Janssen et al. | |
| 4,890,330 | A | 12/1989 | Meyer | |
| 4,918,757 | A | 4/1990 | Janssen et al. | |
| 6,510,230 | B2 * | 1/2003 | Marx | 381/189 |
| 7,013,018 | B2 | 3/2006 | Bøgeskov-Jensen | |
| 7,068,804 | B2 | 6/2006 | Batting | |
| 7,450,732 | B2 * | 11/2008 | Kragelund | 381/323 |
| 7,602,929 | B2 * | 10/2009 | Topholm et al. | 381/322 |
| 7,604,804 | B2 * | 10/2009 | Wang et al. | 424/184.1 |
| 7,646,878 | B2 | 1/2010 | Vonlanthen et al. | |
| 8,331,593 | B2 * | 12/2012 | Slemming et al. | 381/318 |
| 8,442,252 | B2 * | 5/2013 | Meosky et al. | 381/324 |
| 8,571,247 | B1 * | 10/2013 | Oezer | 381/329 |
| 2007/0217641 | A1 | 9/2007 | Rosal | |

(Continued)

FOREIGN PATENT DOCUMENTS

| | | | |
|---|---|---|---|
| CH | 673 743 | A5 | 3/1990 |
| DE | 100 48 337 | C1 | 3/2002 |
| DE | 10 2010 031 699 | A1 | 7/2011 |

(Continued)

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

A hearing aid retainer accessory for use with a hearing aid that comprises a battery compartment to be fitted with a battery drawer, wherein the hearing aid retainer accessory comprises a retainer portion with a connection section that is adapted to be engaged with a hearing aid via a battery drawer.

15 Claims, 8 Drawing Sheets

(56) References Cited

U.S. PATENT DOCUMENTS

2009/0180653 A1 7/2009 Sjursen et al.
2011/0261984 A1* 10/2011 Reber ..... 381/323

FOREIGN PATENT DOCUMENTS

WO WO 2007/147415 A1 12/2007
WO WO 2009/083008 A1 7/2009

* cited by examiner

HEARING AID RETAINER ACCESSORY

CROSS REFERENCE TO RELATED APPLICATIONS

This nonprovisional application claims the benefit of U.S. Provisional Application No. 61/550,931 filed Oct. 25, 2011, and claims priority under 35 U.S.C. 119(a) to Patent Application No. 11186431.0 filed in Europe on Oct. 25, 2011, all of which are hereby expressly incorporated by reference into the present application.

BACKGROUND OF THE INVENTION

The invention is related to a hearing aid retainer accessory for retaining a BTE (behind-the-ear) hearing aid at a user's ear.

In order to operate at best and to prevent damage resulting from falling of the ear and dropping to the ground, a BTE-hearing has to be kept in a safe position at a user's ear. Even so if the user's head moves intensely as is the case doings sport. Another example is a child playing.

US 2007/0217641 A1 discloses a hearing aid protection accessory formed by a flexible sleeve to be wrapped around a housing of a hearing aid, the flexible sleeve to be connected to a users clothing via a clip and a cord. Suitable for preventing the hearing aid from dropping to the ground this arrangement, however, does not allow an adjustment to a user's ear and is likely to entangle with all kinds of obstacles a child may encounter playing. Also the sleeve adds to the thickness of the hearing aid housing rendering it difficult to be placed behind a small ear.

U.S. Pat. Nos. 4,881,616 and 4,702,345 each disclose a hearing aid retainer accessory that is formed by a tube with a respective sleeve connected to each end, both sleeves pulled over the housing of the hearing aid. The arrangement disclosed in U.S. Pat. No. 4,881,616 allows an adjustment to a user ear by moving the sleeves toward or away from each other on the housing of the hearing aid. The degree of adjustment, however, is limited by the longitudinal dimension of the hearing aid housing. The sleeves of both U.S. Pat. No. 4,881,616 and U.S. Pat. No. 4,702,345 add to the thickness of the hearing aid housing, resulting in a discomfort to wear or even the ears protruding, provided they are still in a process of growth. Furthermore, the sleeves are likely to interfere with a control button located at the surface of the hearing aid housing.

U.S. Pat. No. 7,013,018 B2 discloses an adjustable earring for a headset, the earring being connected via a pivotal link to a housing of a speaker included in the headset.

Finally, U.S. Pat. Nos. 4,918,757 and 3,327,807 each disclose an arrangement for retaining a hearing aid at a user's head utilizing a head band. Undesirably each of the arrangements exerts an uncomfortable force to the users head and is rather noticeable.

It is therefore an object of the present invention to provide a hearing aid retainer accessory which avoids the disadvantages of prior art devices and is intuitive and easy to attach, comfortable to wear, free of interference with a hearing aid's control buttons and the specially designed hearing aid geometry, all while retaining a hearing aid at a user's ear safely and stably.

A hearing aid in the scope of the present invention is a BTE-hearing aid or a BTE-like-hearing aid.

SUMMARY OF THE INVENTION

According to a first aspect of the present invention the technical object is achieved by a hearing aid retainer accessory for use with a hearing aid that comprises a battery compartment to be fitted with a battery drawer, wherein the hearing aid retainer accessory comprises a retainer portion with a connection section that is adapted to be engaged with a hearing aid via a battery drawer.

According to a second aspect of the present invention the technical object is achieved by a hearing aid and hearing aid retainer accessory attached thereto. The hearing aid comprises a battery compartment to be fitted with a battery drawer. The hearing aid retainer accessory has a retainer portion with a connection section that is engaged with the hearing aid via a battery drawer.

Engageable or engaged to a hearing aid via a battery drawer, the hearing aid retainer accessory is free of interference with a hearing aid's control buttons and the specially designed hearing aid geometry. Furthermore, the hearing aid retainer accessory is very intuitive and easy to attach to a hearing aid.

It is understood that the embodiments and their advantages described hereafter apply to both the first and the second aspect of the present invention.

In a preferred embodiment, the hearing aid retainer accessory comprises a battery drawer. The battery drawer is adapted to complement a hearing aid's battery compartment. This adds to the easiness of use.

To allow an efficient fabrication and enhanced sturdiness, the retainer portion and the battery drawer can be formed as an integral single piece. In this embodiment the battery drawer constitutes the connection section. The battery drawer can comprise a hinge to be connected to a corresponding hinge pin comprised by a hearing aid's battery compartment, allowing the battery drawer to be swiveled in order to replace its battery.

Alternatively the retainer portion can be releasably connected to the battery drawer. The battery drawer can comprise a coupling means adapted to be connected to a corresponding receiving means comprised by the connection section. The retainer portion is changeable without having to change the battery drawer itself, which is of a particular advantage if the user's ear is still in a process of growth requiring the retainer portion to be changed more often.

In a further alternative embodiment the connection section is adapted to be clicked on a battery drawer as part of a hearing aid. Advantageously the hearing aid retainer accessory can be engaged with a hearing aid via a battery drawer without having to consider changing the battery drawer at all.

In a preferred embodiment the retainer component has a hook-like shape. In light of experience a hook-like shape is especially discreet and comfortable to wear. The retainer component can be configured to be deformable. Provided as a straight elongated portion it can be bent into a desired shape fitting the user's ear geometry best. The retainer element can be spring-like. This has the advantage that the retainer element returns into its original position after having been pushed out for attachment. To provide an especially robust wear for children, the retainer element can be provided a ring going all the way around the ear, the ring being elastic or non-elastic. Alternatively the retainer component can be configured to have a firm shape.

DETAILED DESCRIPTION

Figure 1:
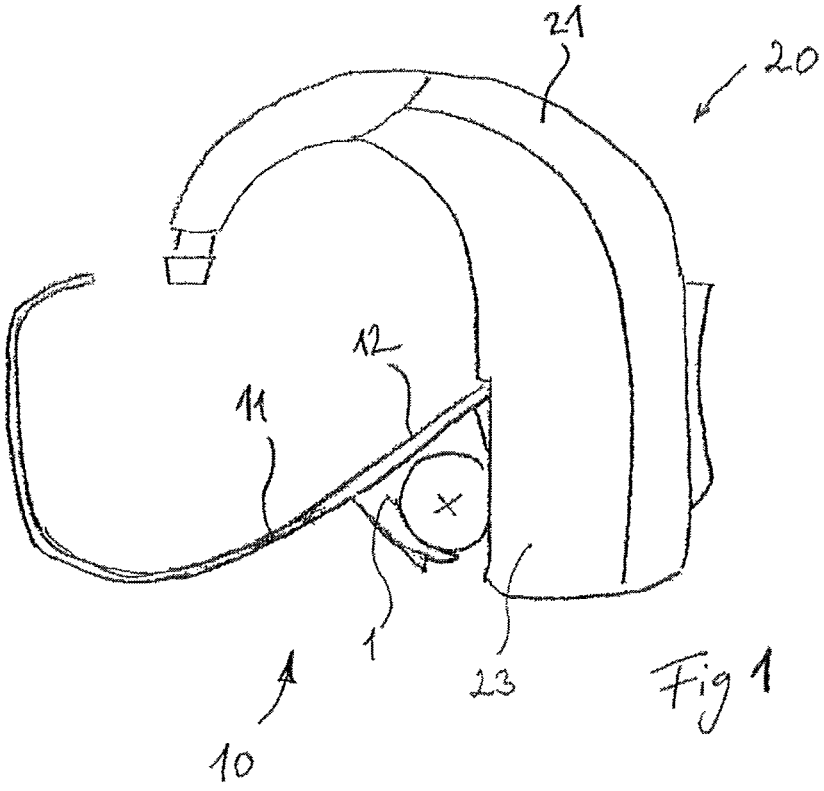
FIG. 1 schematically depicts a side view of a hearing aid retainer accessory connected to a BTE-hearing aid via a battery drawer.

A hearing aid retainer accessory 10 depicted in FIG. 1 comprises a retainer portion 11 with a connection section 12. The hearing aid retainer accessory 10 furthermore comprises a battery drawer 1, wherein the battery drawer 1 and the retainer portion 11 are formed as an integral single piece. The battery drawer 1 constitutes the connection section 12 and is connected to a BTE-hearing aid 20 having a housing 21 with a battery compartment 23. The battery drawer 1 of hearing aid retainer accessory 10 is adapted to complement said battery compartment 23. The retainer portion 11 is bent into a hook-like shape.

Figure 2:
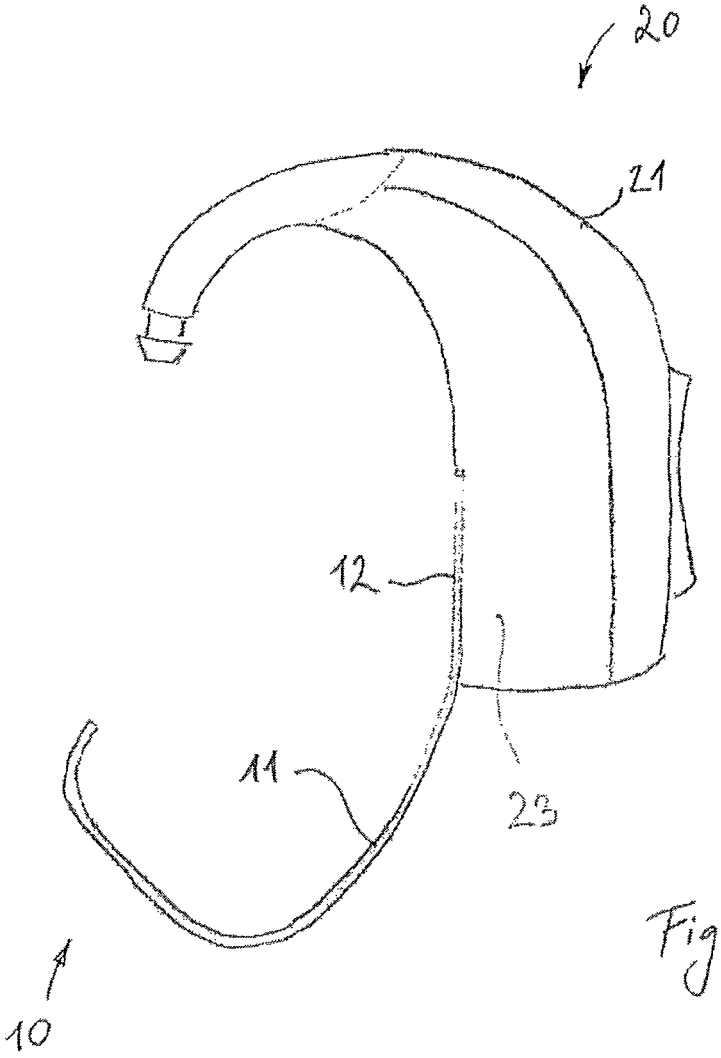
FIG. 2 shows the arrangement of FIG. 1 with closed battery drawer.

The arrangement of FIG. 1 with closed battery drawer 1 is shown in FIG. 2. The hearing aid retainer accessory 10 is free of interference with a hearing aid's control buttons and the specially designed hearing aid geometry. The hearing aid retainer accessory 10 does not add to the circumferential geometry of the housing 21 of the BTE-hearing aid 20.

Figure 3:
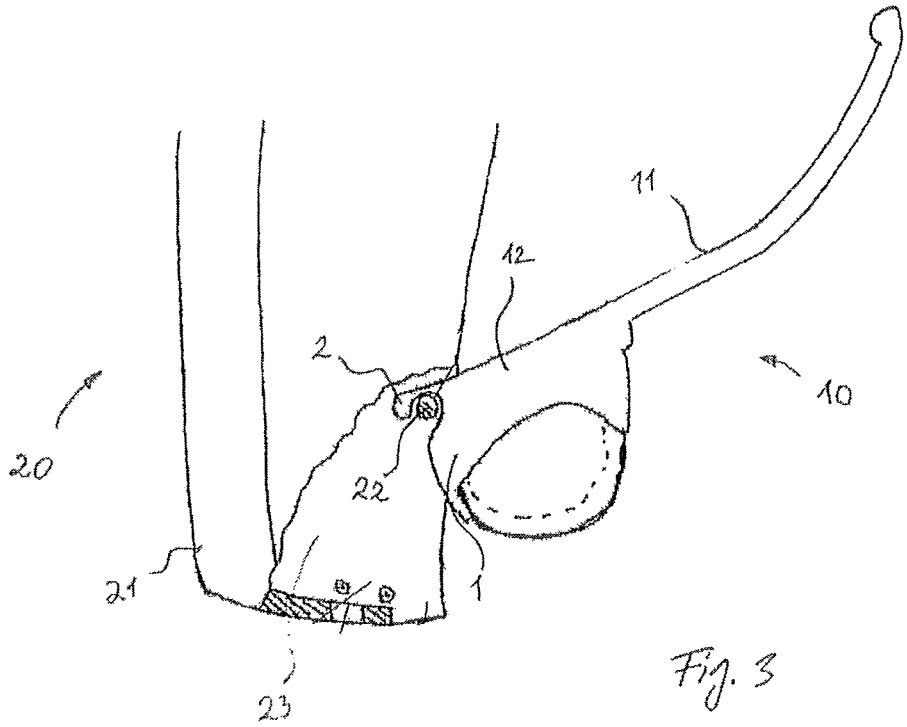
FIG. 3 shows a detail of the arrangement of FIG. 2 with a cutting profile of a battery compartment.

FIG. 3 shows in detail how the hearing aid accessory 10 of FIG. 1 and FIG. 2 are attached to a BTE-hearing aid 20 via the battery drawer 1. The battery drawer 1 comprises a hinge 2 connected to a corresponding hinge pin 22 comprised by a hearing aid's 20 battery compartment 23. The battery drawer 1 can be swiveled in order to replace the battery.

Figure 4:
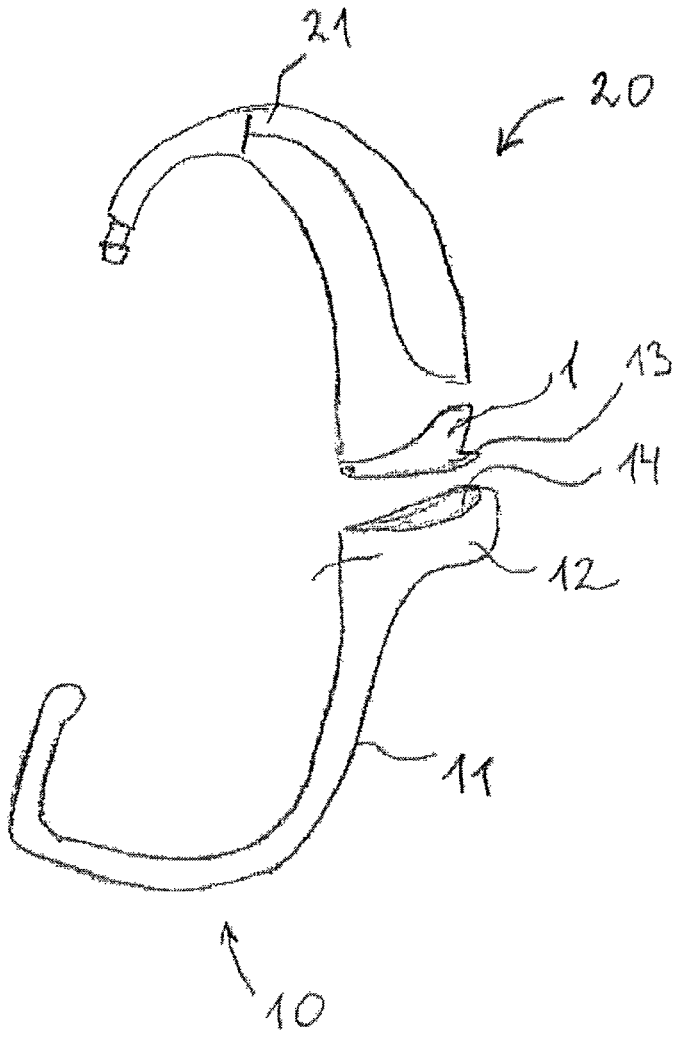
FIG. 4 schematically depicts a side view of an alternative embodiment of a hearing aid retainer accessory adapted to be clicked on a battery drawer as part of a BTE-hearing aid.

A BTE-hearing aid 20 in FIG. 4 comprises a housing 21 with a battery drawer 1, the battery drawer 1 being part of the BTE-hearing aid 20, located at a longitudinal end portion. A hearing aid accessory 10 comprises hook-like retainer portion 11 with a connection section 12. The connection section is adapted to be clicked on the battery drawer 1.

Figure 5:
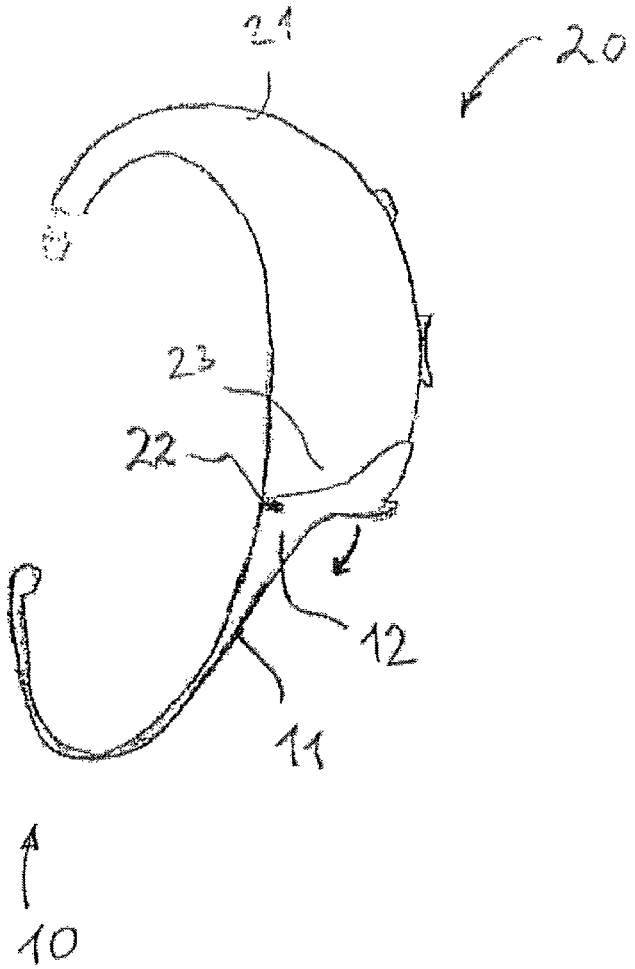
FIG. 5 schematically depicts a side view of a further embodiment of a hearing aid retainer accessory connected to a BTE-hearing aid via a battery drawer.

FIG. 5 shows another example of a hearing aid accessory 10 being connected to a BTE-hearing aid 20 via a battery drawer 1. The battery drawer 1 and the retainer portion 11, both comprised by the hearing aid accessory 10, are formed as an integral single piece. The battery drawer 1 constitutes a connection section 12 and is connected to the housing 21. A hinge pin 22, being part of a battery compartment 23 comprised by the hearing aid 20, is connect to a battery drawer's 20 hinge 2.

Figure 6:
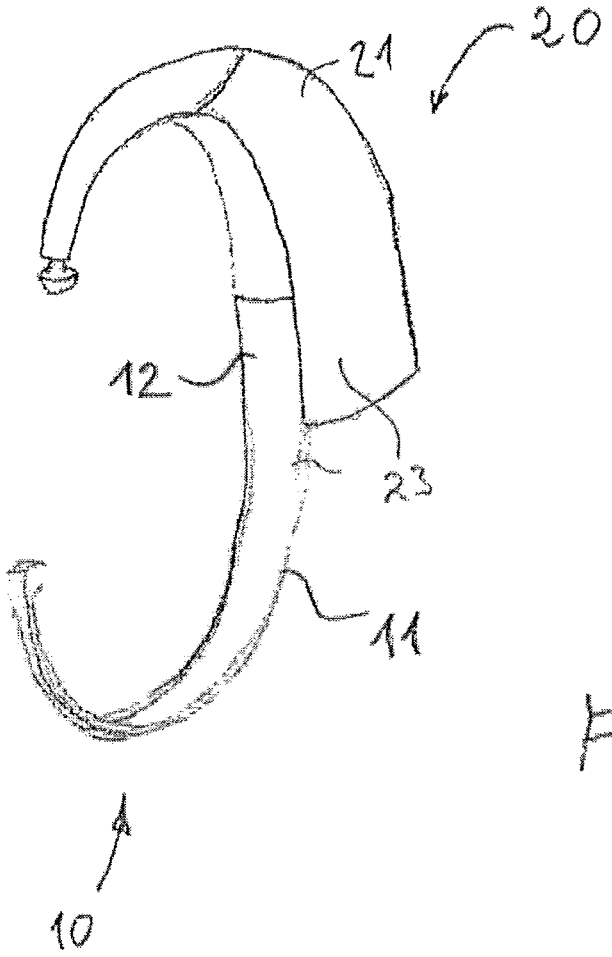
FIG. 6 schematically depicts a side view of an embodiment of a hearing aid retainer accessory with a retainer component having a firm shape.

Another example of a hearing aid retainer accessory 10 connected to a BTE-hearing via a battery drawer 1 is shown in FIG. 6. The hearing aid retainer accessory 10 has a retainer component 11 with a firm shape. The battery drawer 1 and the retainer portion 11 are formed as an integral single piece, wherein the battery drawer 1 constitutes a connection section 12. Again the hearing aid retainer accessory 10 is free of interference with a hearing aid's control buttons and the specially designed hearing aid geometry. The hearing aid retainer accessory 10 does not add to the circumferential geometry of the housing 21 of the BTE-hearing aid 20.

Figure 7:
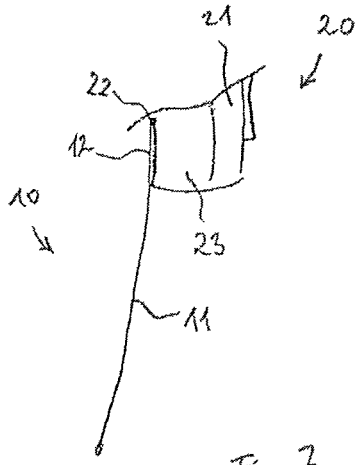
FIG. 7 schematically depicts a perspective view of a hearing aid retainer accessory with a retainer component provided as a bendable straight elongated portion.
Figure 8:
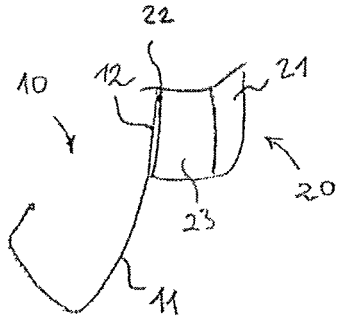
FIG. 8 shows the arrangement of FIG. 7 after the retainer component was bent into a desired shape fitting the user's ear geometry.

FIG. 7 and FIG. 8 schematically depict a side view of a hearing aid retainer accessory 10 with a retainer component 11 provided being bendable. FIG. 7 shows the retainer component to have a straight elongated shape initially. In FIG. 8 retainer component 11 is show having been bent into a desired shape fitting the user's ear geometry. In both FIG. 7 and FIG. 8 the battery drawer 1 and the retainer portion 11 are formed as an integral single piece, wherein the battery drawer 1 constitutes a connection section 12.

Figure 9:
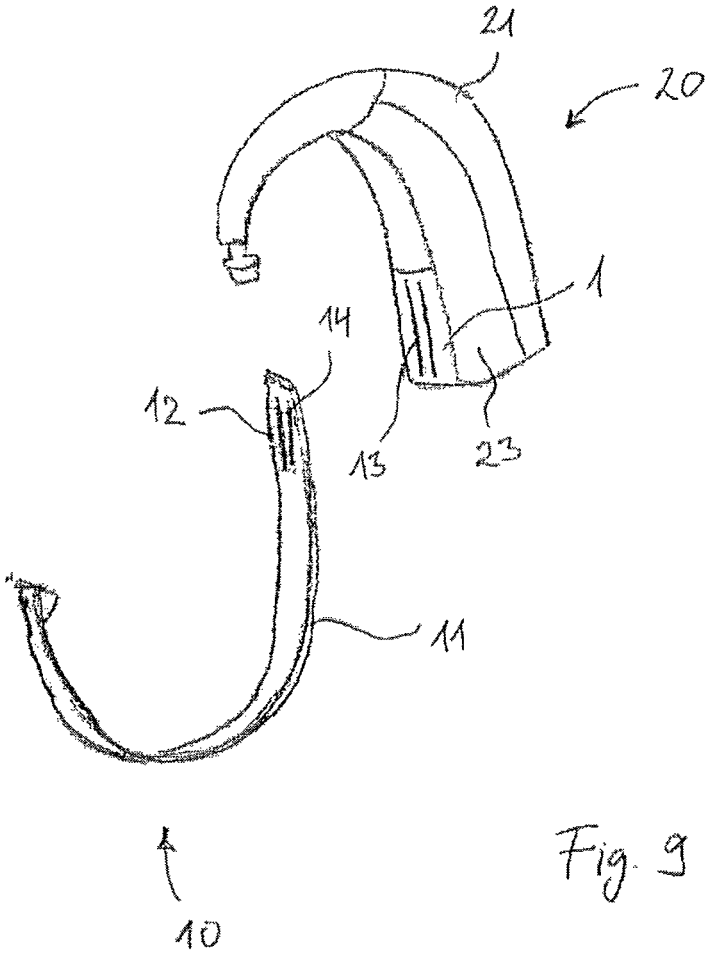
FIG. 9 schematically depicts a side view of an alternative embodiment of a hearing aid retainer accessory releasably connected to a battery drawer.

FIG. 9 shows an alternative embodiment of a hearing aid retainer accessory 10 with a retainer portion 11 having a connection section 12 that is adapted to be engaged with a BTE-hearing aid 20 via a battery drawer 1. The BTE-hearing aid 20 has a housing 21 with a battery compartment 23. The battery drawer 1 which has a coupling means 13 is adapted to complement the hearing aid's 20 battery compartment. The connecting section 12 of retainer portion 11 comprises receiving means 14 complementary to the coupling means 13. By said coupling means 13 and said receiving means 14 the connection section 12, and therefore the hearing aid retainer accessory 10, are releasably connected to battery drawer 1. The battery drawer 1 is comprised by the hearing aid retainer accessory 10.

The invention claimed is:

1. A hearing aid retainer accessory for use with a behind-the-ear (BTE) hearing aid that includes a battery compartment to be fitted with a battery drawer, the hearing aid retainer accessory comprising:

a retainer portion with a connection section that is configured to be engaged with the BTE hearing aid via the battery drawer;

the battery drawer including a hinge adapted to be connected to a corresponding hinge pin comprised by the battery compartment of the BTE hearing aid; and the retainer portion adapted to extend from behind an ear of a user of the BTE hearing aid.

2. The hearing aid retainer accessory according to claim 1, wherein the hearing aid retainer accessory comprises the battery drawer adapted to complement the battery compartment comprised by the BTE hearing aid.

3. The hearing aid retainer accessory according to claim 2, wherein the retainer portion and said battery drawer are formed as an integral single piece, with the battery drawer being said connection section.

4. The hearing aid retainer accessory according to claim 2, wherein said connection section is releasably connected to said battery drawer.

5. The hearing aid retainer accessory according to claim 4, wherein said battery drawer comprises a coupling means adapted to be connected to a corresponding receiving means comprised by said connection section.

6. The hearing aid retainer accessory according to claim 1, wherein the connection section is adapted to be clicked on the battery drawer as part of the BTE hearing aid.

7. The hearing aid retainer accessory according to any of the claims 1 to 6, wherein the retainer component has a hook-like shape.

8. The hearing aid retainer accessory according to any of the claims 1 to 5, wherein the retainer component is configured to be deformable or spring-like.

9. The hearing aid retainer accessory according to any of the claims 1 to 5, wherein the retainer component is configured to have a firm shape.

10. A behind-the-ear (BTE) hearing aid and a hearing aid retainer accessory attached thereto, the BTE hearing aid comprising a battery compartment to be fitted with a battery drawer, the hearing aid retainer accessory comprising a retainer portion with a connection section that is engaged with the BTE hearing aid via the battery drawer;

the battery drawer comprising a hinge connected to a corresponding hinge pin comprised by the battery compartment of the BTE hearing aid; and the retainer portion extending from behind an ear of a user of the BTE hearing aid.

11. The BTE hearing aid and the hearing aid retainer accessory according to claim 10, wherein the hearing aid retainer accessory comprises a battery drawer adapted to complement the battery compartment comprised by the BTE hearing aid.

12. The BTE hearing aid and the hearing aid retainer accessory according to claim 11, wherein the retainer portion and said battery drawer are formed as an integral single piece, with the battery drawer being said connection section.

13. The BTE hearing aid and the hearing aid retainer accessory according to claim 11, wherein the retainer portion is releasably connected to the battery drawer.

14. The BTE hearing aid and the hearing aid retainer accessory according to claim 13, wherein said battery drawer comprises a coupling means connected to a corresponding receiving means comprised by said connection section.

15. The BTE hearing aid and the hearing aid retainer accessory according to claim 10, wherein the connection section is clicked on a battery drawer as part of the hearing aid.

* * * * *